US008038310B1

(12) United States Patent
Hale et al.

(10) Patent No.: US 8,038,310 B1
(45) Date of Patent: Oct. 18, 2011

(54) GLOVE ILLUMINATION SYSTEM AND METHOD

(75) Inventors: Michael J. Hale, Los Angeles, CA (US); Thomas B. Fitzgerald, Simi Valley, CA (US); John Caper, Valencia, CA (US); Howie Idelson, Pacific Palisades, CA (US); Janne Levanen, Alta Loma, CA (US)

(73) Assignee: Mechanix Wear, Inc., Valencia, CA (US)

( * ) Notice: Subject to any disclaimer, the term of this patent is extended or adjusted under 35 U.S.C. 154(b) by 0 days.

(21) Appl. No.: 12/898,083

(22) Filed: Oct. 5, 2010

(51) Int. Cl.
*F21V 21/08* (2006.01)

(52) U.S. Cl. ..... 362/103; 362/157; 362/191; 362/194; 362/253; 362/368; 2/159; 2/160

(58) Field of Classification Search ..... 362/103, 362/157, 190, 191, 194, 253, 368; 2/159, 2/160

See application file for complete search history.

(56) References Cited

U.S. PATENT DOCUMENTS

| | | | |
|---|---|---|---|
| 1,230,943 | A | 6/1917 | Sundh |
| 3,638,011 | A | 1/1972 | Bain et al. |
| 4,422,131 | A | 12/1983 | Clanton et al. |
| 5,283,722 | A | 2/1994 | Koenen et al. |
| 5,345,368 | A | 9/1994 | Huff |
| 5,535,105 | A | 7/1996 | Koenen et al. |
| 5,673,436 | A | 10/1997 | Piper |
| 6,006,357 | A | 12/1999 | Mead |
| 6,529,121 | B2 | 3/2003 | Bush |
| 6,805,460 | B1 | 10/2004 | Zoller et al. |
| 6,892,397 | B2 | 5/2005 | Raz et al. |
| 7,152,248 | B2 | 12/2006 | Ziemer |
| 2001/0048596 | A1 | 12/2001 | Kerr |
| 2005/0034212 | A1 | 2/2005 | Eisenbraun |
| 2006/0007669 | A1 | 1/2006 | Blackburn |
| 2006/0146517 | A1 | 7/2006 | Park |
| 2007/0058362 | A1 | 3/2007 | Winfrey |

*Primary Examiner* — Diane Lee
*Assistant Examiner* — Meghan Dunwiddie
(74) *Attorney, Agent, or Firm* — Eric Karich

(57) ABSTRACT

An illumination system has a glove and an illumination device. The illumination device may be attached to an upper portion of the glove via first and second fastening materials. The illumination device includes a battery operably connected with a light source through a switch, for illuminating a selected part of a work space. A plurality of pliant support legs of the illumination device extend generally radially outwardly and downwardly, for supporting the housing upon the back of the hand. The first fastening material has a width and a length that are dimensioned so that the illumination device may be removably attached to the glove via the second fastening material to point in any of 360 degrees of rotation, such that the light source directs illumination in a selected direction with respect to the glove.

5 Claims, 4 Drawing Sheets

GLOVE ILLUMINATION SYSTEM AND METHOD

CROSS-REFERENCE TO RELATED APPLICATIONS

Not Applicable

BACKGROUND OF THE INVENTION

1. Field of the Invention

This invention relates generally to illumination systems, and more particularly to a glove illumination system that includes an illumination device that can be mounted on a glove in any orientation to illuminate a selected part of a work space.

2. Description of Related Art

Mechanics, plumbers, electricians and others use gloves every day for a variety of tasks, which include tasks that are performed in small, dark areas requiring dexterity as well as illumination. Different conventional ways of illuminating these areas include a hand held flashlight, or portable light mounted or hung adjacent to the area. Often times, however, it is awkward holding a flashlight while performing the task and there is no convenient location to mount or hang a light so that the desired area is effectively illuminated. Also, when working in the area the user's hands or arms can block the light.

Various prior art references teach light devices that are adapted to be mounted on a glove, so that the light is provided where needed, without the user having to hold the light device.

Raz et al., U.S. Pat. No. 6,892,397, teaches a glove with integrated light for illuminating a work area. The glove includes a housing adjacent a knuckle portion of the glove for containing an illumination device. A second housing mounted on the back of the glove includes a battery for powering the illumination device, and circuitry operably connects the two. While the Raz glove provides excellent illumination for particular purposes, the illumination device cannot be customized so that the light is directed in another direction.

Myers et al., U.S. Pat. No. 5,535,105, entitled "Work Glove and Illuminator Assembly," discloses a surgical or worker glove having an illuminator in a light housing on one of the glove fingers, with the illuminator oriented to project a light beam distally of the glove. The light source for the illuminator can be self-contained within the light housing or can utilize fiber optics to transmit light to the illuminator from a remote light source. Another embodiment discloses a translucent glove wherein the output of the illumination means is disposed on the interior of the glove and the light shines through a fingertip of a glove.

One disadvantage of the glove in the Myers et al. patent is that its light housing is bulky and extends a significant distance above the surface of the finger. This can result in the housing interfering with a task being performed in a tight space. The fiber optic embodiments rely on a light source external to the gloves which adds complexity and cost. All of the embodiments have a light source attached to one of the glove fingers and as a task is being performed, the fingers move. This movement can result in the light moving from the desired area when performing the task. Further, the light on the fingertip embodiment would be blocked by any dirt, oil, grease, blood, etc. that accumulates on the glove fingers during use.

Clanton, et al., U.S. Pat. No. 4,422,131, is entitled "Finger Light," and discloses a light worn on, and turned on by, a finger. It has a substantially hollow tubular housing with an opening at one end through which a finger can be inserted. The light source is self-contained in the opposite closed end of the housing. Pressure from the finger activates a light, which provides illumination through the closed end. One disadvantage of this arrangement is that the light emanates from the end of the finger, and as the fingers move during a task, the light can move off the desired area. This device also prevents bending of the portion of the finger within the tubular housing, reducing dexterity. The housing is also made of rubber or plastic and the light source is arranged at the end of the finger, such that the user's tactile feel is blocked.

Bain, et al., U.S. Pat. No. 3,638,011, is entitled "Hand Glove and Light Attachment Therefore," and discloses a glove with a light housing that is attached to a finger and extends a significant distance above the surface of the finger. This configuration is bulky, cumbersome, and would likely be damaged when used in tight spaces. Like the gloves above, the light source in this device is also mounted on the finger such that it will move from the desired area during use.

Sundh, U.S. Pat. No. 1,230,943, is entitled "Portable Light," and discloses a glove with a leather strip that extends transversely across the back of the glove and also longitudinally toward the wrist. A number of light sockets are riveted to the strip, and near the wrist a pocket is included for batteries to power lights mounted in the sockets.

Ziemer, U.S. Pat. No. 7,152,248, teaches a flashlight glove that includes an LED flashlight held in a pocket on the back of the glove, along with a battery pack. The LED flashlight cannot be rotated or otherwise positioned, but simply shines directly forward from the back of the hand.

Other similar glove illumination devices that cannot be customized to point in any direction, within 360 degrees of rotation, include Kerr, U.S. 2001/0048596, and Huff, U.S. Pat. No. 5,345,368, both of which only direct light forward along the back of the hand.

The above-described references are hereby incorporated by reference in full.

The prior art teaches various forms of gloves with illumination devices. However, the prior art does not teach an illumination device that may be rotated 360 degrees with respect to the glove so that the user can select a desired part of a work space to illuminate. The prior art also does not teach an illumination device that includes a plurality of pliant support legs for mounting the illumination device securely yet comfortably on the back of the hand of the user. The present invention fulfills these needs and provides further related advantages as described in the following summary.

SUMMARY OF THE INVENTION

The present invention teaches certain benefits in construction and use which give rise to the objectives described below.

The present invention provides an illumination system adapted to be worn on a back of a hand. The illumination system comprises a glove adapted to be worn on the hand, the glove including an upper portion adapted for overlaying the back of the hand; a first fastening material mounted to the upper portion of the glove; an illumination device having a housing with a top surface, a bottom surface, and an interior space; a battery operably connected with a light source through a switch, the battery being positioned within the interior space of the housing and the light source being operably mounted upon the housing; a plurality of pliant support legs of the housing extending generally radially outwardly and downwardly, the pliant support legs being shaped for supporting the housing upon the back of the hand; and a second fastening material mounted to the bottom surface of the pliant support legs, the second fastening material being adapted to lockingly engage the first fastening material for removably mounting the housing to the glove, wherein the first fastening material has a width and a length that are dimensioned so that the illumination device may be removably attached to the glove via the second fastening material to point in any of 360 degrees of rotation, such that the light source directs illumination in a selected direction with respect to the glove.

A primary objective of the present invention is to provide an illumination system having advantages not taught by the prior art.

Another objective is to provide an illumination system that includes a glove and an illumination device that may be rotated 360 degrees with respect to the glove so that the user can select a desired part of a work space to illuminate.

A further objective is to provide an illumination system that includes a plurality of pliant support legs for mounting the illumination device securely yet comfortably on the back of the hand of the user.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, an illumination system 10 adapted to be worn on a back of a hand 12 for illuminating a work space.

Figure 1:
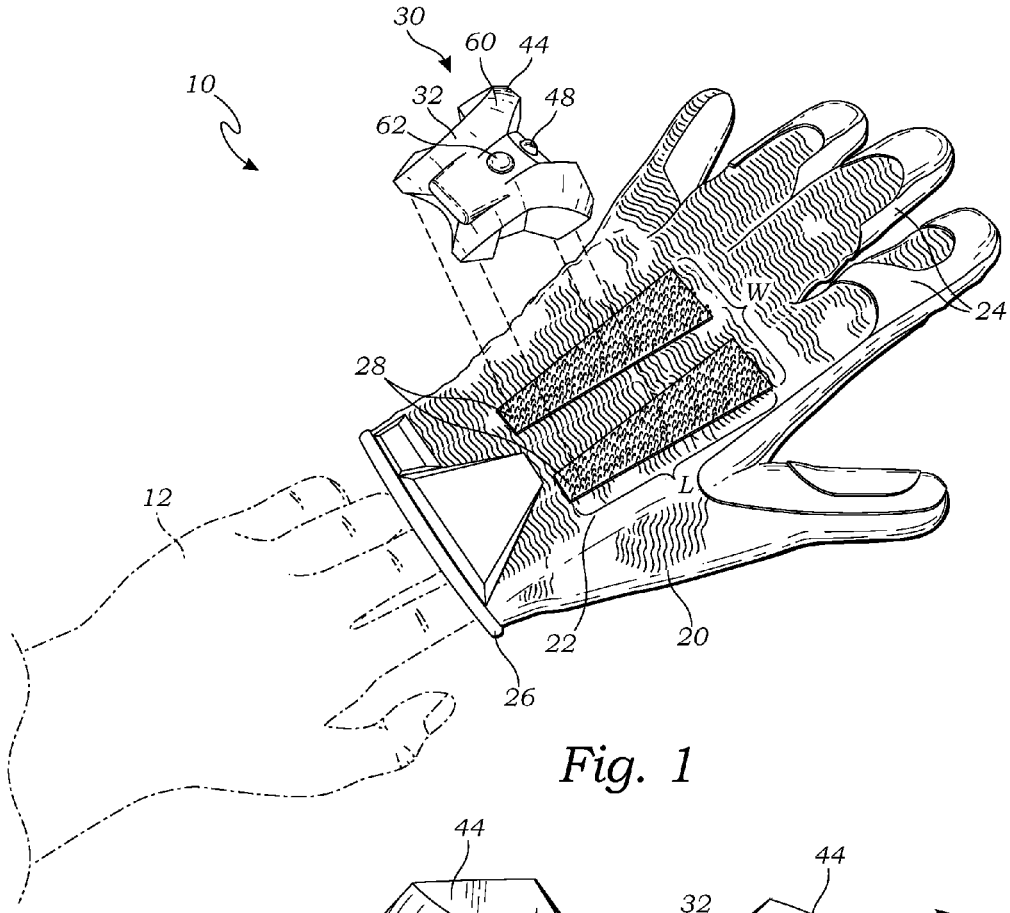
FIG. 1 is an exploded perspective view of an illumination system according to one embodiment of the present invention, the illumination system including a glove and an illumination device.
Figure 2:
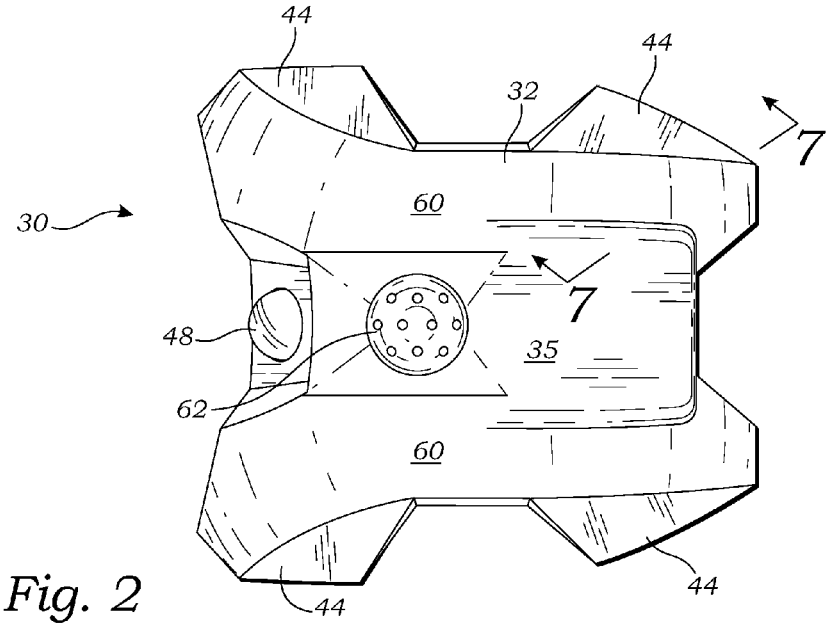
FIG. 2 is a top plan view of the illumination device.
Figure 7:
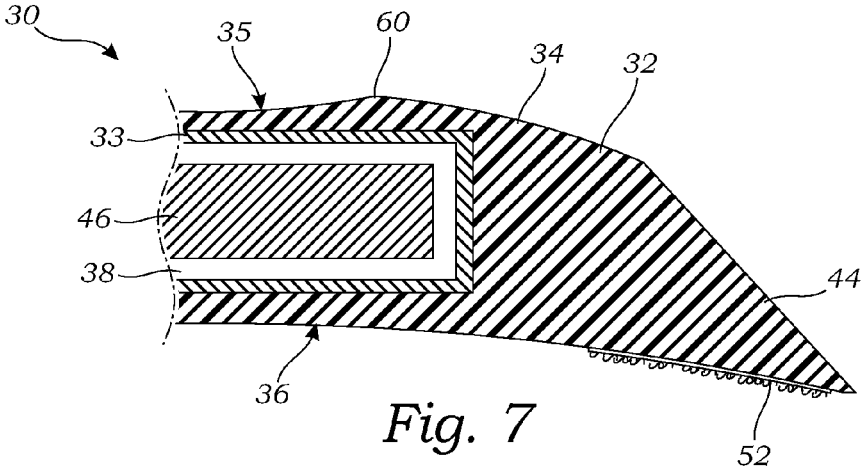
FIG. 7 is a sectional view thereof taken along line 7-7 in FIG. 2.

FIG. 1 is an exploded perspective view of an illumination system 10 according to one embodiment of the present invention. As illustrated in FIG. 1, the illumination system 10 including a glove 20 and an illumination device 30. FIGS. 2-6 are different views of the illumination device 30, and FIG. 7 is a sectional view thereof taken along line 7-7 in FIG. 2.

As shown in FIG. 1, the illumination system 10 includes the glove 20, which is adapted to be worn on the hand 12 of a user for illuminating a work space. The glove 20 including an upper portion 22 adapted for overlaying the back of the hand 12. The glove 20 may further include finger elements 24 for receiving the user's fingers, and an opening 26 for receiving the hand 12 into the interior (not shown) of the glove 20.

A first fastening material 28 is mounted to the upper portion 22 of the glove 20 for mounting the illumination device 30 thereupon. In one embodiment, the first fastening material 28 is a hooks and loops fastening material such as VELCRO®. In other embodiments, however, other fastening materials or elements known to those skilled in the art may also be used.

As shown in FIGS. 1-7 the illumination device 30 includes a housing that may include a top surface 35, a bottom surface 36, and an interior space 38. In the present embodiment, the housing 32 includes an inner structure 33 that is rigid (e.g., molded plastic, or a similar/equivalent material) and a softer outer structure 34 (e.g., rubber or rubber-like material, or a similar/equivalent material). In alternative embodiments, the housing 32 may be a single construction, or any equivalent construction for containing a battery 46 and mounting a light source 48, as discussed below.

The housing 32 may include a plurality of pliant support legs 44 that extend generally radially outwardly and downwardly. For purposes of this application, the term "radially" is broadly defined to include any generally outward protrusion consistent with this application, and should not be narrowly construed to more limited geometric definitions. The pliant support legs 44 may be shaped for supporting the housing 32 upon the back of the hand 12, preferably with a slight curvature to fit securely and comfortably against the hand 12. The plurality of pliant support legs 44 may be formed of a molded rubber or rubber-like material so that the illumination device 30 fits securely against the user's hand 12, but the support legs 44 are soft enough to not bruise the hand 12, especially in the event of an accidental impact against the illumination device 30.

Figure 8:
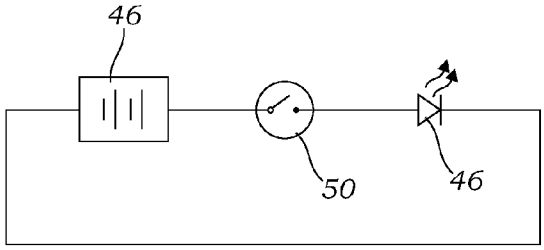
FIG. 8 is an electrical schematic of a light source of the illumination device.

In the present embodiment, the battery 46 is positioned within the interior space 38 of the housing 32. The battery 46 is operably connected with the light source 48 through a switch 50, as illustrated in FIG. 8. The light source 48 (e.g., incandescent lamp, LED, etc.) may be operably mounted on or within the housing 32 in any manner known to those skilled in the art. As used in this application, the term "operably mounted upon the housing" is hereby defined to broadly include any manner of mounting on, within, or adjacent to and operably supported by the housing 32.

Figure 3:
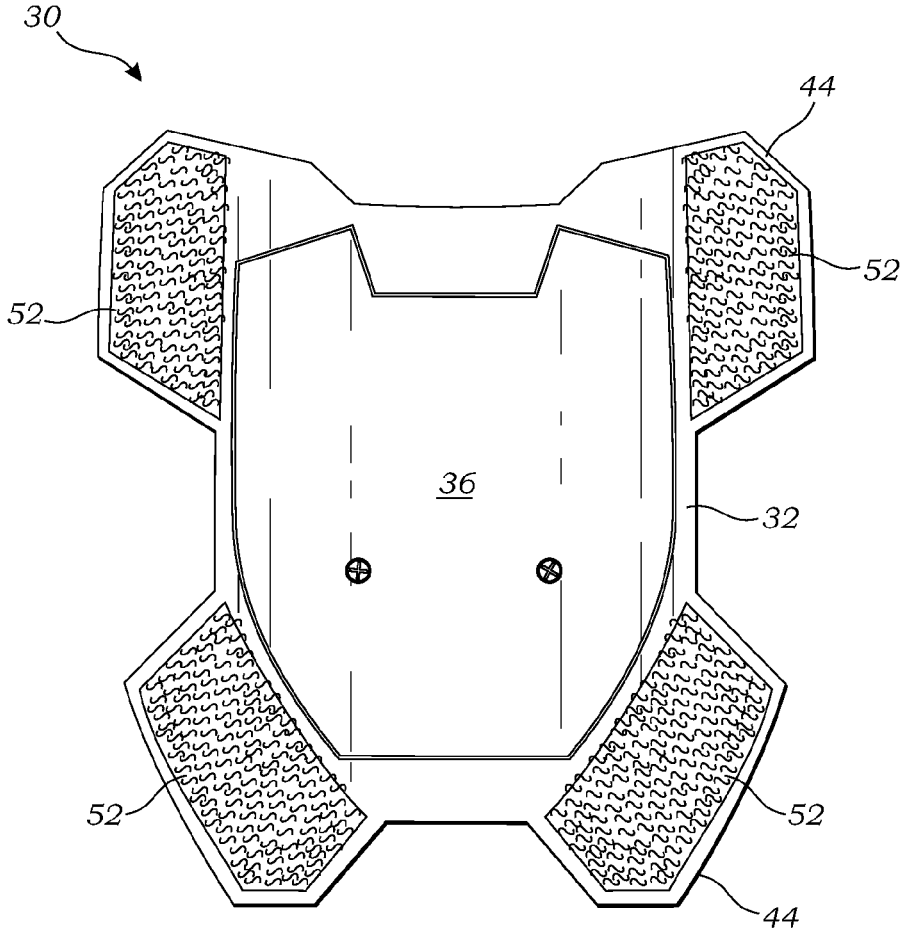
FIG. 3 is a bottom plan view thereof.
Figure 4:
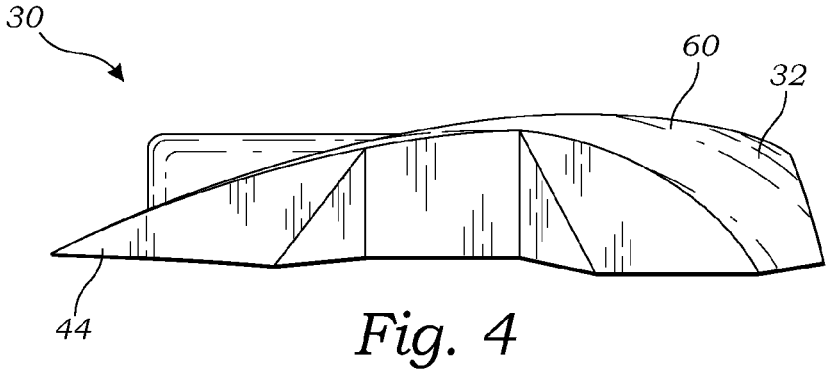
FIG. 4 is a side elevational view thereof.
Figure 5:
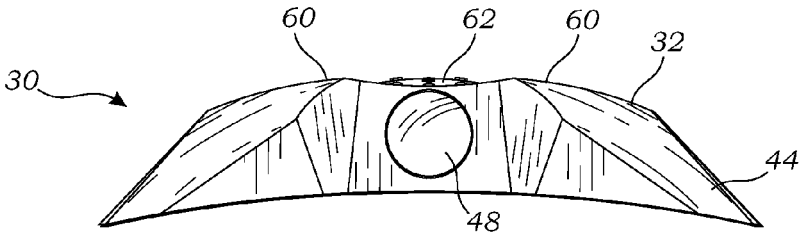
FIG. 5 is a front elevational view thereof.
Figure 6:
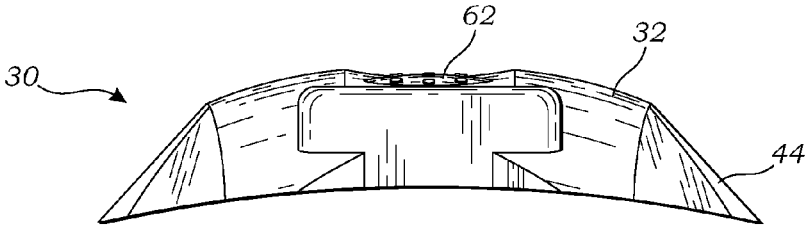
FIG. 6 is a rear elevational view thereof.

As illustrated in FIGS. 3 and 7, a second fastening material 52 (e.g., hooks and loops fastener, or other suitable fastening material or device) is mounted to the bottom surface 36 of the pliant support legs 44. The second fastening material 52 is adapted to lockingly engage the first fastening material 28 for removably mounting the housing 32 to the glove 20. The first fastening material 28 has a width W and a length L that are dimensioned so that the illumination device 30 may be removably attached to the glove 20 via the second fastening material 52 to point in any of 360 degrees of rotation, such that the light source 48 directs illumination in a selected direction with respect to the glove 20 and hand 12. The first and second fastening materials 28 and 52 together enable the housing 32 to be removably attached to the glove 20 in different orientations such that the light source 48 directs illumination in a selected direction to a desired part of the work space, with respect to the glove 20.

In one embodiment, as best illustrated in FIGS. 2 and 4-6, a pair of shoulders 60 extend upwardly from the top surface 35 of the housing 32. The pair of shoulders 60 are adapted for protecting a button 62 positioned between the pair of shoulders 60. The button 62 controls the switch 50, and the pair of shoulders 60 extend upwardly further than the button 62, so that the button 62 is protected against accidental actuation by the pair of shoulders 60.

Figure 9:
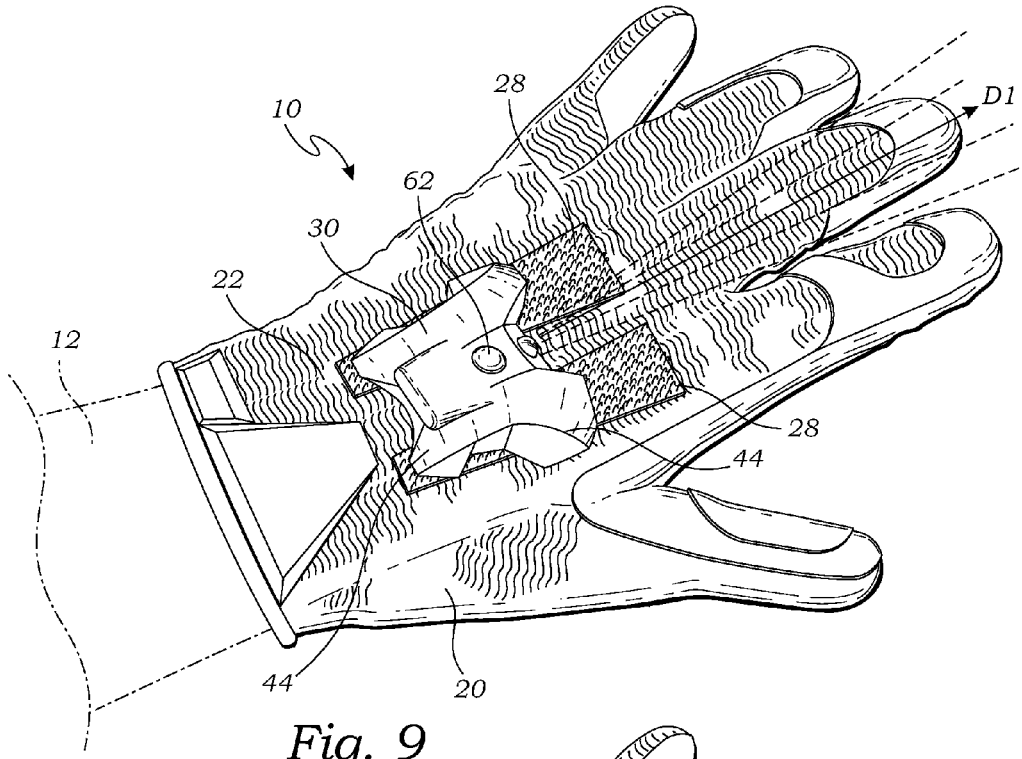
FIG. 9 is a perspective view of the illumination system illustrating the illumination device in a first orientation with respect to the glove.
Figure 10:
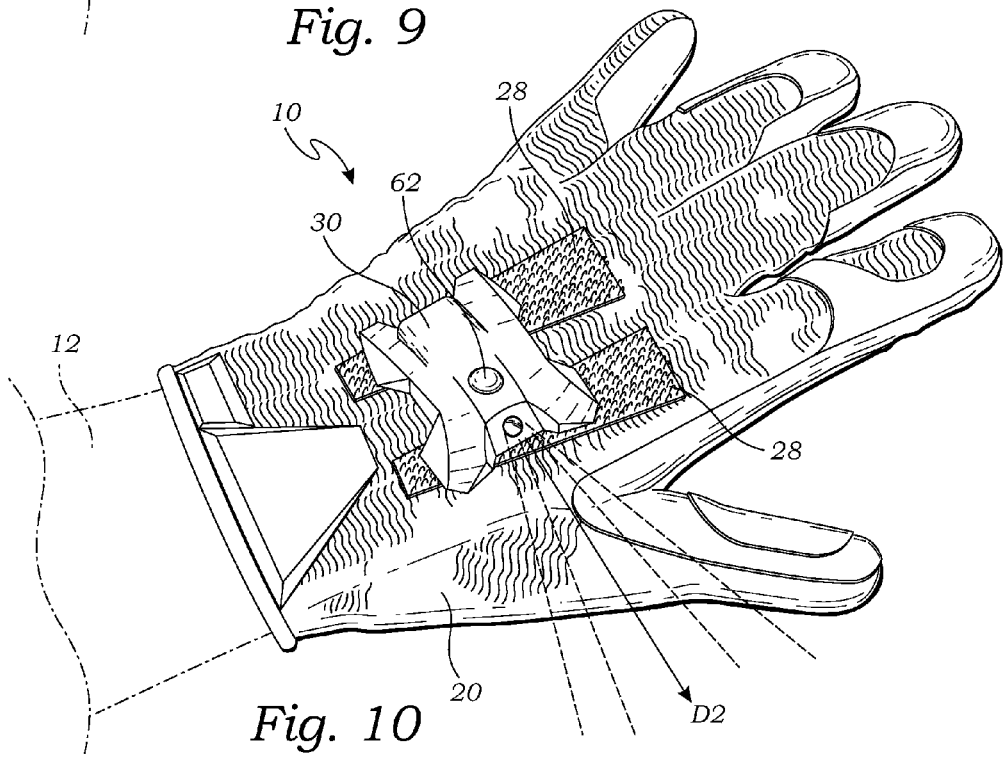
FIG. 10 is a perspective view of the illumination system illustrating the illumination device in a second orientation with respect to the glove.

FIG. 9 is a perspective view of the illumination system 10 illustrating the illumination device 30 in a first orientation with respect to the glove 20, and FIG. 10 illustrates the illumination device 30 in a second orientation with respect to the glove 20. FIGS. 9-10 illustrate a method for illuminating a work space using the illumination system 10 described above.

Using the provided illumination system 10, the glove 20 is placed on a hand 12 of the user, and the illumination device 30 is oriented with respect to the glove 20 in a first direction D1 so that light from the light source 48 will illuminate a desired part of the work space when the illumination device 30 is attached to the glove 20 and the user is wearing the glove 20. The illumination device 30 is then attached to the glove 20 in that orientation using the first and second fastening materials 28 and 52. Once attached, the switch is actuated to electronically connect the light source 48 to the battery 46, thereby powering the light source 48 and illuminating the work space.

The user can then work in the work space (e.g., under the hood of a car, within an electrical circuit box, or any other location that may require added illumination while the user works with his or her hand 12*s* in that area) with proper illumination. If during the course of work the light is needed in a different orientation, the light device may be readily removed, rotated to a second orientation, such that the light is directed in a second direction D2 as illustrated in FIG. 10, and then reattached. Such customizable orientation may be achieved quickly and easily, without interfering with the work being performed.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. An illumination system adapted to be worn on a hand, the illumination system comprising:

a glove adapted to be worn on the hand;

a first fastening material mounted to the glove;

an illumination device having a housing with a top surface and a bottom surface;

a battery operably connected with a light source through a switch, the battery, the light source, and the switch being operably positioned on or within the illumination device;

a plurality of pliant support legs extending from the housing for supporting the illumination device on the hand;

a second fastening material mounted to the bottom surface of the housing for removably engaging the illumination device with the first fastening material of the glove, wherein the first fastening material has a width and a length that are dimensioned so that the illumination device may be removably attached to the glove via the second fastening material to point in any of 360 degrees of rotation;

a pair of shoulders extending upwardly from the illumination device; and a button positioned between the pair of shoulders, the button controlling of the switch, wherein the pair of shoulders extend upwardly further than the button, so that the button is protected against accidental actuation by the pair of shoulders.

2. The illumination system of claim 1, wherein the plurality of pliant support legs are formed of a molded rubber or rubber-like material.

3. The illumination system of claim 1, wherein the first and second fastening materials are hooks and loops fastening material.

4. An illumination system adapted to be worn on a back of a hand, the illumination system comprising:

a glove adapted to be worn on the hand, the glove including an upper portion adapted for overlaying the back of the hand;

a first fastening material mounted to the upper portion of the glove;

an illumination device having a housing with a top surface, a bottom surface, and an interior space;

a battery operably connected with a light source through a switch, the battery being positioned within the interior space of the housing and the light source being operably mounted upon the housing;

a plurality of pliant support legs of the housing extending generally radially outwardly and downwardly, the pliant support legs being shaped for supporting the housing upon the back of the hand;

a second fastening material mounted to the bottom surface of the pliant support legs, the second fastening material being adapted to lockingly engage the first fastening material for removably mounting the housing to the glove, wherein the first fastening material has a width and a length that are dimensioned so that the illumination device may be removably attached to the glove via the second fastening material to point in any of 360 degrees of rotation, such that the light source directs illumination in a selected direction with respect to the glove;

a pair of shoulders extending upwardly from the top surface of the housing; and a button positioned between the pair of shoulders, the button controlling of the switch, wherein the pair of shoulders extend upwardly further than the button, so that the button is protected against accidental actuation by the pair of shoulders.

5. An illumination system adapted to be worn on a hand, the illumination system comprising:

a glove adapted to be worn on the hand, the glove including an upper portion adapted for overlaying the back of the hand, and fingers;

a first fastening material mounted to the glove;

an illumination device having a housing with a top surface, a bottom surface, connected by a side surface;

a light source mounted on the side surface;

a battery operably connected with the light source through a switch, the battery and the switch being operably positioned within the illumination device, between the top and bottom surfaces; and a second fastening material mounted to the bottom surface of the housing for removably engaging the illumination device with the first fastening material of the glove, whereby the light source may be oriented to direct light towards the fingers of the glove, or in any other direction within 360 degrees of rotation from this orientation, rotated about the back of the hand of the user.

* * * * *